US005970517A

United States Patent [19]

Jordan

[11] Patent Number: 5,970,517

[45] Date of Patent: Oct. 26, 1999

[54] SAFETY HARNESS WITH INTEGRAL SUPPORT LINE

[75] Inventor: Omar P. Jordan, Twinsburg, Ohio

[73] Assignee: Rapid Intervention Technologies, Inc., Twinsburg, Ohio

[21] Appl. No.: 09/149,945

[22] Filed: Sep. 9, 1998

[51] Int. Cl.[6] ..... A41D 13/00; A47L 3/04

[52] U.S. Cl. ..... 2/69; 2/81; 2/94; 2/227; 2/305; 2/310; 2/338; 2/97; 182/3; 244/143; 244/151 R

[58] Field of Search ..... 2/93, 69, 79, 81, 2/108, 227, 229, 236, 338, 230, 44, 92, 102, 300, 94, 97, 301, 305, 307–310, 312, 319–321, 69.5, 70; 182/3–6, 11, 231; 244/138 R, 142, 143, 151 R

[56] References Cited

U.S. PATENT DOCUMENTS

| | | | |
|---|---|---|---|
| 2,156,210 | 4/1939 | Upson | 244/143 |
| 2,290,218 | 7/1942 | Vosseller | 244/143 |
| 2,729,425 | 1/1956 | Gschwind | 254/157 |
| 3,074,074 | 1/1963 | Lovering . | |
| 3,880,255 | 4/1975 | Huntley | 182/5 |
| 3,973,643 | 8/1976 | Hutchinson . | |
| 4,161,266 | 7/1979 | Howarth, Jr. . | |
| 4,273,216 | 6/1981 | Weissmann . | |
| 4,302,847 | 12/1981 | Miles | 2/2 |
| 4,449,253 | 5/1984 | Hettinger . | |
| 4,625,335 | 12/1986 | Vinai . | |
| 4,674,599 | 6/1987 | Nelson | 182/231 |
| 4,706,858 | 11/1987 | Whatley . | |
| 4,714,135 | 12/1987 | Bell et al. | 182/6 |
| 4,731,882 | 3/1988 | Ekman | 2/69 |
| 4,802,264 | 2/1989 | Isenhart | 24/241 |
| 4,850,554 | 7/1989 | Strong | 244/151 R |
| 4,854,418 | 8/1989 | Hengstenberger et al. . | |
| 4,938,435 | 7/1990 | Varner et al. | 244/142 |
| 4,955,456 | 9/1990 | Mulkey . | |
| 5,024,360 | 6/1991 | Rodriguez | 224/218 |
| 5,036,548 | 8/1991 | Grilliot et al. . | |
| 5,136,724 | 8/1992 | Grilliot et al. . | |
| 5,351,340 | 10/1994 | Aldridge . | |
| 5,450,627 | 9/1995 | Grilliot et al. . | |
| 5,487,444 | 1/1996 | Dennington | 182/6 |
| 5,542,124 | 8/1996 | Grilliot et al. . | |
| 5,548,842 | 8/1996 | Wiseman, Sr. . | |
| 5,581,901 | 12/1996 | Takahashi | 33/756 |
| 5,611,085 | 3/1997 | Rasmussen . | |
| 5,671,822 | 9/1997 | Phillips | 182/5 |
| 5,815,834 | 10/1998 | Bronson | 2/102 |
| 5,842,542 | 12/1998 | Tien | 182/231 |

FOREIGN PATENT DOCUMENTS

| | | | |
|---|---|---|---|
| 862431 | 12/1940 | France | 244/142 |
| 859964 | 1/1941 | France | 244/148 |
| 316581 | 3/1918 | Germany | 244/143 |

OTHER PUBLICATIONS

Firehouse, Mar. 1998, Firehouse Marketplace.

CMC Rescue Equipment, Catalog 119, pp. 13, 47, 65, and 80–81.

*Primary Examiner*—John J. Calvert

*Assistant Examiner*—Tejash D Patel

*Attorney, Agent, or Firm*—Pearne, Gordon, McCoy & Granger LLP

[57] ABSTRACT

A harness assembly having an integral support line. The harness assembly includes a harness body having first and second ends and a hollow interior which receives the support line. The support line has first and second ends that extend from the harness body. The harness is secured within a garment. The garment has a front opening which is normally covered by a releasable flap. The first and second ends of the support line extend through the front opening and are accessible when the flap is moved to an open position. The first end of the support line may be pulled away from the harness to extend the support line therefrom. The second end of the support line is secured to the harness.

25 Claims, 4 Drawing Sheets

SAFETY HARNESS WITH INTEGRAL SUPPORT LINE

BACKGROUND OF THE INVENTION

FIELD OF THE INVENTION

The present invention is directed toward a safety harness having an integral support line.

DESCRIPTION OF RELATED ART

Firefighters traditionally wear outer clothing that is known in the art as turnout gear. Turnout gear includes a large coat and pants that have an inner liner and an outer layer. The outer layer or shell is constructed from materials that are resistant to abrasion, flame, heat, and water. The inner liner is releasably secured to the outer layer to permit the liner to be removed for cleaning and repair purposes. The inner liner is preferably constructed from materials which provide a heat and moisture barrier.

It is known in the art to incorporate a harness into firefighter turnout gear. In this regard, see U.S. Pat. Nos. 5,036,548; 5,136,724; 4,625,335; 3,973,643; 4,273,216; 4,449,253; and, 4,854,418, the disclosures of which are expressly incorporated herein in their entireties.

Other patents disclose garments which include a harness and a drag line. For example, U.S. Pat. No. 4,706,858 discloses a hunting vest that incorporates a drag line that may be secured to a deer for dragging the deer. U.S. Pat. No. 3,074,074 discloses a similar device wherein the harness includes a pouch in which the drag line is stored. See also, U.S. Pat. No. 4,955,456. It is noted that, in these references, the disclosures of which are expressly incorporated herein in their entireties, the drag line is secured and accessible at a rear of the garments.

Finally, U.S. Pat. No. 4,161,266 discloses a lifeline carrier which is carried in an elongated tubular container that is attached to a back-carried air tank.

In addition to the turnout gear coat and pants, firefighters also wear a helmet, thick gloves, and a large oxygen tank. As can be appreciated, the equipment is heavy and bulky, and there is understandably a great resistance by firefighters to add any further equipment to what is already in use.

Unfortunately, for firefighters entering a burning building, especially a high-rise building, the conventional equipment does not include means to facilitate escape from a window or roof of the building. Moreover, for a firefighter who is injured and incapable of escaping from the building, the conventional equipment does not include means to facilitate lifting, lowering, or dragging the injured firefighter from the building.

In the past, an unsatisfactory solution to this problem has been to carry lengths of rope in a coat pocket or a coil of rope over-the-shoulder. However, in a burning building, it takes too long to find the rope, remove it from the pocket, and secure the rope to something/someone to permit escape or rescue. A coil of rope tends to get snagged on things in the building, or is otherwise inconvenient for the firefighter to carry. Therefore, it is common for firefighters to enter tall buildings during a fire with no means of escape.

Accordingly, when a firefighter is trapped several floors above the ground, he must now go to a window and hope that his colleagues can get a ladder up to him before he is injured by the fire. When a firefighter is incapacitated, he must be physically lifted and carried, or dragged by his coat by a rescuer. Due to the failure of conventional equipment to provide means to assist in escape/rescue of firefighters, many firefighters are injured and killed each year by being unable to escape from upper floors of multi-floor buildings.

Therefore, there exists a need in the art for a means to facilitate escape from upper floors of a building. There also exists a need in the art for a means and method for rescuing incapacitated people from buildings. Finally, there exists a need in the art for firefighter turnout gear that incorporates such escape and rescue means.

SUMMARY OF THE INVENTION

The present invention is directed toward facilitating escape from upper floors of a building and rescue of injured people from a building. The present invention is also directed toward an escape and rescue line that is built into a harness assembly. The present invention is further directed toward a harness assembly which is incorporated into firefighter turnout gear.

In accordance with the present invention, firefighter turnout gear includes a harness assembly which is secured around the firefighters mid-section. The harness assembly is removably fastened to an interior of the firefighter turnout gear. The harness assembly includes a harness body and a support line. The support line is movable relative to the harness body, is accessible from an exterior of the turnout gear, and is easily deployed. In accordance with an alternative embodiment of the present invention, the support line is incorporated into a module which is inserted into an accommodating chamber in the harness body.

In further accordance with the present invention, firefighter turnout gear includes an outer layer and an inner liner. The harness assembly is removably secured to one of the outer layer and inner liner. At least one end of the support line extends through an opening in the outer layer and is accessible to a user on an exterior of the outer layer.

In further accordance with the present invention, the support line has a first end with a first carabiner-type clip secured thereto and a second end with a second carabiner-type clip secured thereto. The first end is movable relative to the harness body by pulling the first end and carabiner away from the harness body. The second end is fixed relative to the harness body and is not readily movable relative thereto.

In further accordance with the present invention, the harness body defines a chamber which receives a support line module. The support line module includes the support line. once the support line is used, the module is removed from the chamber, and a new module is inserted into the chamber to permit the harness to be re-used while allowing the support line to be easily re-installed into the harness body.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
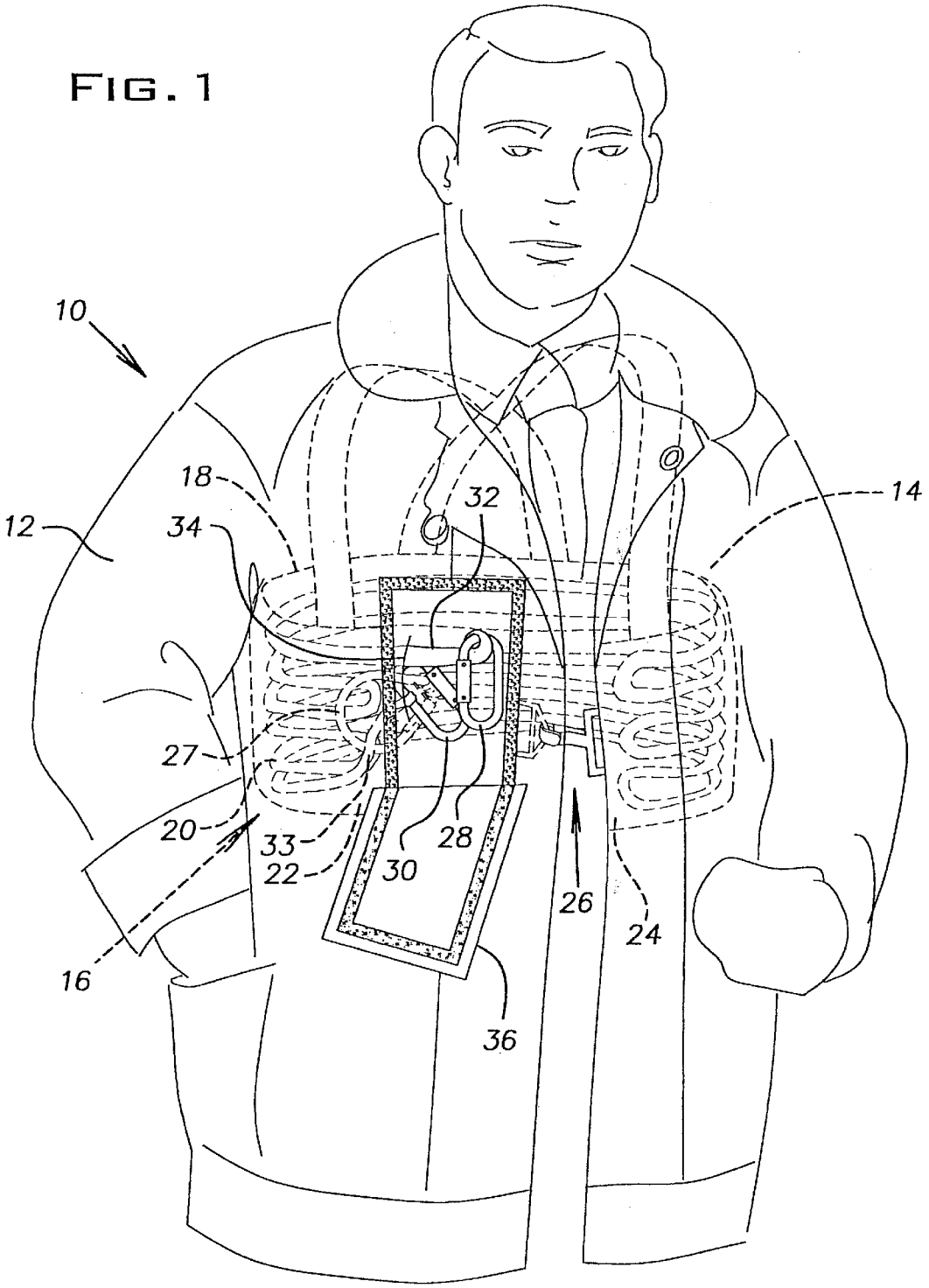
FIG. 1 is a schematic illustration of a firefighter wearing a turnout gear coat including a harness assembly according to the present invention.

It should be noted that in the detailed description which follows, identical components have the same reference numeral, regardless of whether they are shown in different embodiments of the present invention. It should also be noted that, in order to clearly and concisely disclose the present invention, the drawings may not necessarily be to scale and certain features of the invention may be shown in somewhat schematic form.

With reference to FIG. 1, a firefighter turnout gear coat 10 according to the present invention is illustrated. The coat 10 includes an outer layer 12 formed from abrasion, flame, and water resistant material and an inner liner 14 which is a heat and moisture barrier. The inner liner 14 is removably secured to the outer layer 12 to permit the inner liner 14 to be removed for purposes of cleaning and repair. It is submitted that the turnout gear coat described in this paragraph is conventional and well known in the art. Such a coat 10 is also generally described in U.S. Pat. No. 5,542,124, the disclosure of which is expressly incorporated by reference herein in its entirety.

Figure 4:
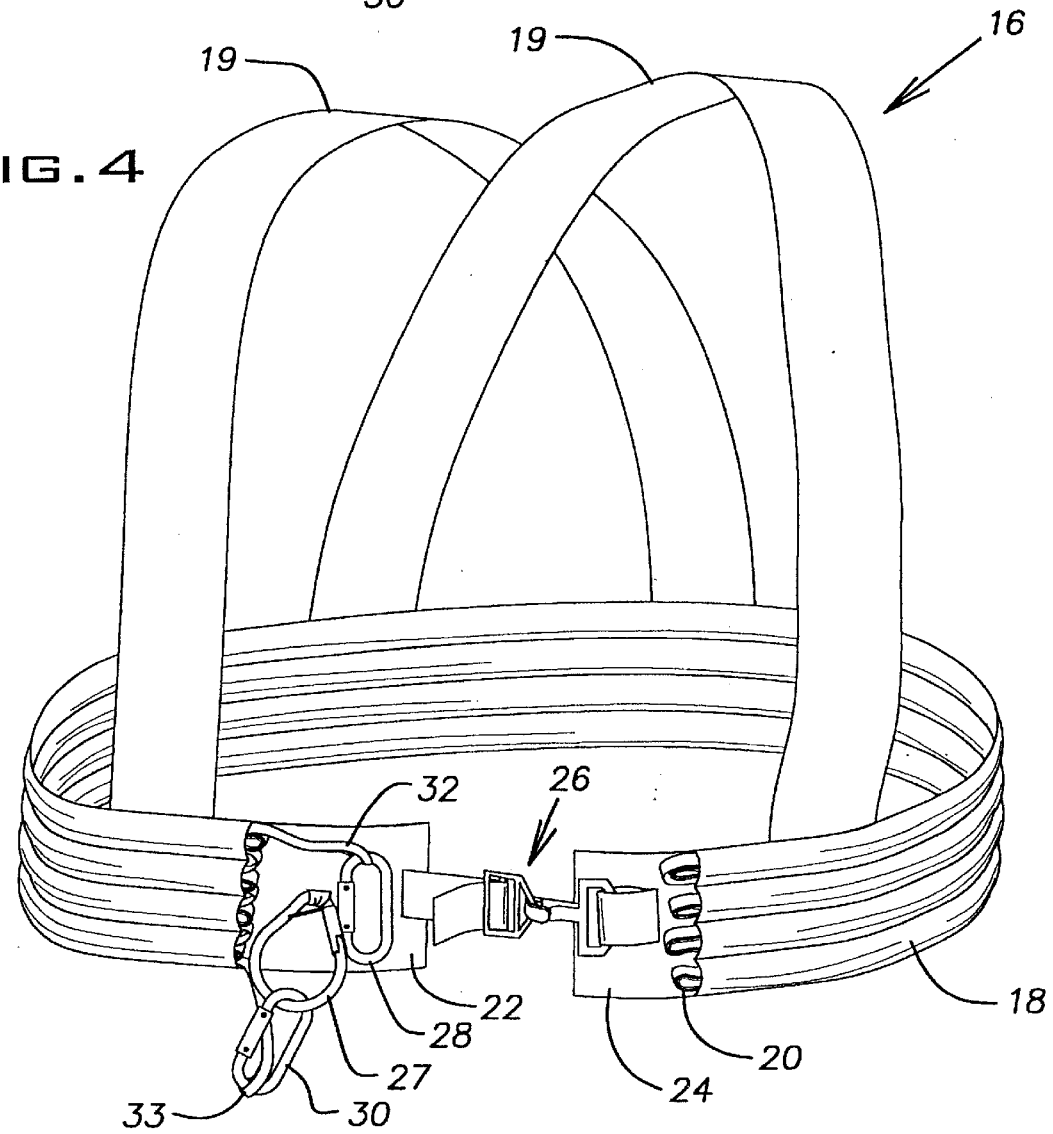
FIG. 4 is a perspective view of the harness assembly of FIG. 1.

With reference to FIGS. 1 and 4, secured within the coat 10 is a harness assembly 16. The harness assembly 16 includes a harness body 18, a pair of shoulder straps 19, and a support line 20. The harness body 18 is generally constructed as a hollow length of material having a first end 22 and a second end 24. As such, the harness body 18 is generally shaped as a belt having an internal chamber for receipt of the support line 20. The first and second ends 22, 24 of the harness body 18 are preferably secured together when the coat 10 is closed, such as by a clip-and-ring fastener 26. Preferably, the shoulder straps 19 and body 18 are adjustable in length to accommodate different size people.

The harness body 18 is preferably secured to an inner surface of the coat outer layer 12 in a releasable fashion, such as by a series of snap fasteners, hook-and-loop type fasteners, zippers, or other suitable means of releasable attachment. Instead of being secured to the inner surface of the outer layer 12, the harness body 18 may be alternatively secured to the outer surface of the liner 14, or to the inner surface of the liner.

The support line 20 is preferably very long relative to the length of the harness body 18. The length of the support line 20 is dependent upon the available volume in the hollow harness body 18, the cross-sectional area of the line itself, and the allowable weight of the harness assembly 16. It has been found that a support line 20 having a flat ribbon shape is preferable as such a shape provides maximum strength while minimizing size and weight. It has been further found that providing a support line 20 having a high temperature resistance is necessary due to the environment in which the line will be used. Taking these factors into consideration, the support line 20 is preferably a flat ribbon of heat resistant synthetic fabric, such as Kevlar. A harness assembly 16 according to the present invention with fifty feet of Kevlar support line 20 was found to weigh only about 2–3 pounds, and was hardly noticeable to the wearer thereof.

The harness body 18 has a carabiner-type harness clip 27 sewn or otherwise fixedly secured thereto. A carabiner-type clip 28, 30 is also secured to each end of the support line 20. As used herein, the term "carabiner-type clip" is intended to refer to any known or hereafter developed clip which forms a closed loop, has a closure member which is spring biased to a closed position, and which is easily opened by the user.

A first one of the carabiners 28 is secured to a first end 32 of the support line 20 and may be pulled outwardly away from the harness body 18 to withdraw the support line 20 from the harness body 18. A second one of the carabiners 30 is secured to a second end 33 of the support line 20 and is clipped or secured to the harness clip 27. Accordingly, the second end 33 of the support line 20 is releasably anchored to the harness body 18 through the clips 27, 30. When the support line 20 is completely withdrawn from the harness body 18, the second end 33 of the support line 20 is releasably secured to the harness body 18 until the user disconnects the second carabiner 30 from the harness clip 27.

Each of the first and second carabiners 28, 30 extend from the harness body 18 and through a slot-like hole 34 in the outer layer 12 so as to be accessible to the wearer or others from an exterior of the coat 10. The carabiners 28, 30 and the hole 34 are normally covered or concealed by a releasable flap 36. The flap 36, which is shown in an open position in FIG. 1, is normally secured in an upright or closed position, preferably by a hook-and-loop type closure, and is simply pulled downwardly to expose the carabiners 28, 30.

Figure 2:
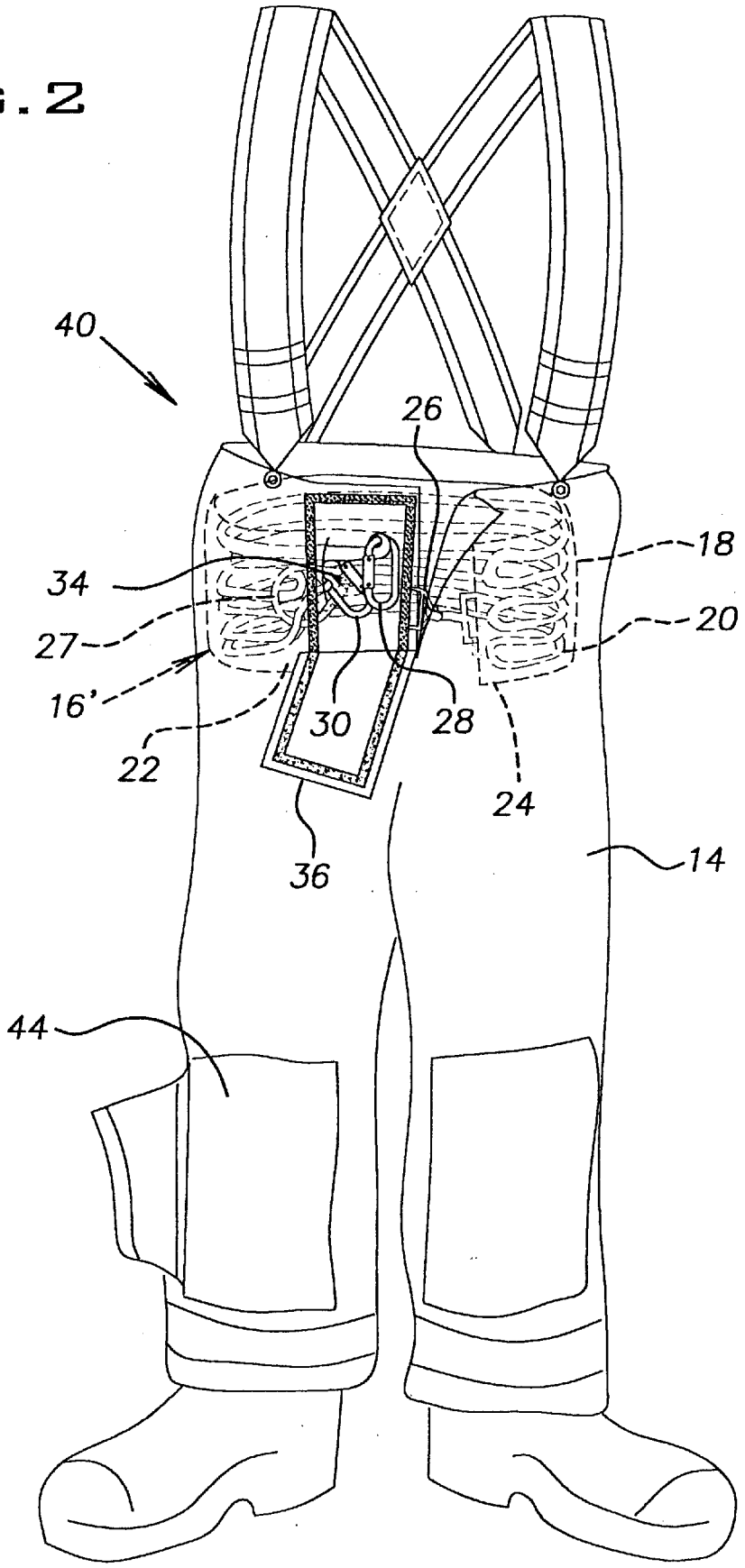
FIG. 2 is a schematic illustration of firefighter turnout gear pants including a harness assembly according to the present invention.
Figure 3:
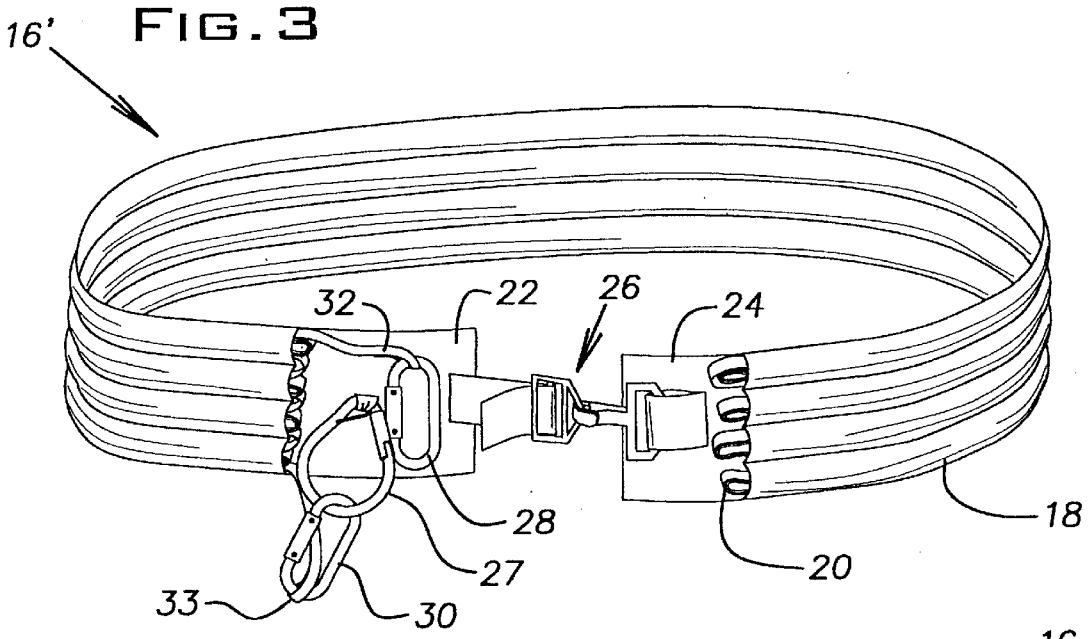
FIG. 3 is a perspective view of the harness assembly of FIG. 2.

With reference to FIGS. 2 and 3, a second embodiment of the present invention is illustrated wherein a harness assembly 16' is incorporated into turnout gear pants 40. In the following description of the second embodiment, identical reference numerals will be used as in the first embodiment when appropriate.

The pants 40 are constructed generally identically to the coat shown in FIG. 1, and have an outer layer 12 and a removable inner liner 14. A harness assembly 16' is preferably secured to the interior surface of the outer layer 12 near a waist portion of the pants 40. Alternatively, the harness assembly 16' may be secured to the inner or outer surface of the inner liner 14, as desired.

As in the previously described first embodiment, the harness assembly 16' includes a harness body 18 and a support line 20. The harness body 18 is generally constructed as a hollow length of material having a first end 22 and a second end 24. As such, the harness body 18 is generally shaped as a belt having an internal chamber for receipt of a support line 20. The first and second ends 22, 24 of the harness body 18 are preferably secured together when the pants 40 are closed, such as by a clip-and-ring type fastener 26. The harness body 18 is secured to the selected internal surface of the pants 40 in a desired releasable manner, as described hereinbefore.

The support line 20 is preferably very long relative to the length of the harness body 18, and is preferably made from a flat ribbon of synthetic, heat-resistant fabric, such as Kevlar or the like. The harness body 18 has a harness clip 27 sewn or otherwise fixedly secured thereto.

A carabiner 28, 30 is secured to each end of the support line 20. A first one of the carabiners 28 is secured to a first end 32 of the support line 20 and may be pulled outwardly away from the harness body 18 to withdraw the support line 20 from the harness body 18. A second one of the carabiners 30 is fixedly secured to the harness clip 27 and is releasably anchored to the harness body 18 therethrough.

Each of the carabiners 28, 30 extend from the harness body 18 and through a slot-like hole 34 in the outer layer 12 so as to be accessible to the wearer or others from an exterior of the pants 40. The carabiners 28, 30 and the hole 34 are normally covered or concealed by a releasable flap 36. The flap 36, which is shown in an open position in FIG. 2, is normally secured in an upright or closed position, preferably by a hook-and-loop type fabric closure, and is simply pulled downwardly to expose the carabiners 28, 30.

In either embodiment, should a firefighter need the support line 20 or a support, the flap 36 can pulled down to expose the carabiners 28, 30. Thereafter, the first carabiner 28 can be pulled to extend the support line 20 from the harness assembly 16. Alternatively, an additional line (not shown) can be secured to the second carabiner 30 to facilitate lifting of the firefighter.

In the event of a window escape, the first carabiner 28 could be secured to a fixed support or a large piece of furniture to permit the firefighter to exit the building via a window. Alternatively, the firefighter may secure the first carabiner 28 to a telescoping rod or other tool (not shown) which is specially made or adapted for jamming into windows to support of the firefighter during the repel from the window. Such a tool may be stored in a pants pocket 44 or a coat pocket (not shown). When the firefighter reaches ground level or otherwise wants to disconnect from the support line 20, he simply has to release the second carabiner 30 from the harness clip 27 to free himself from the support line 20.

It is believed that the ability to escape from a window of a burning building is of great importance for firefighters. It is further believed that, even when the elevation is such that the support line 20 will not extend to the ground level, the importance of being able to exit the building via the window cannot be overemphasized. This is because fires are oftentimes confined to one or two floors of a building. Therefore, it is possible that, by exiting the floor that is on fire and lowering himself two or three floors down, the firefighter can escape danger of injury in the fire, and be in a better position to escape from the building.

In the event that a first firefighter is helping rescue a second, injured firefighter, the first firefighter could secure his first carabiner 28 to the injured firefighter's second carabiner 30, and thereafter hoist, drag, or lower the injured firefighter to safety. Accordingly, the second carabiner 30 can serve as a point of attachment to facilitate rescue of an injured firefighter.

Figure 5:
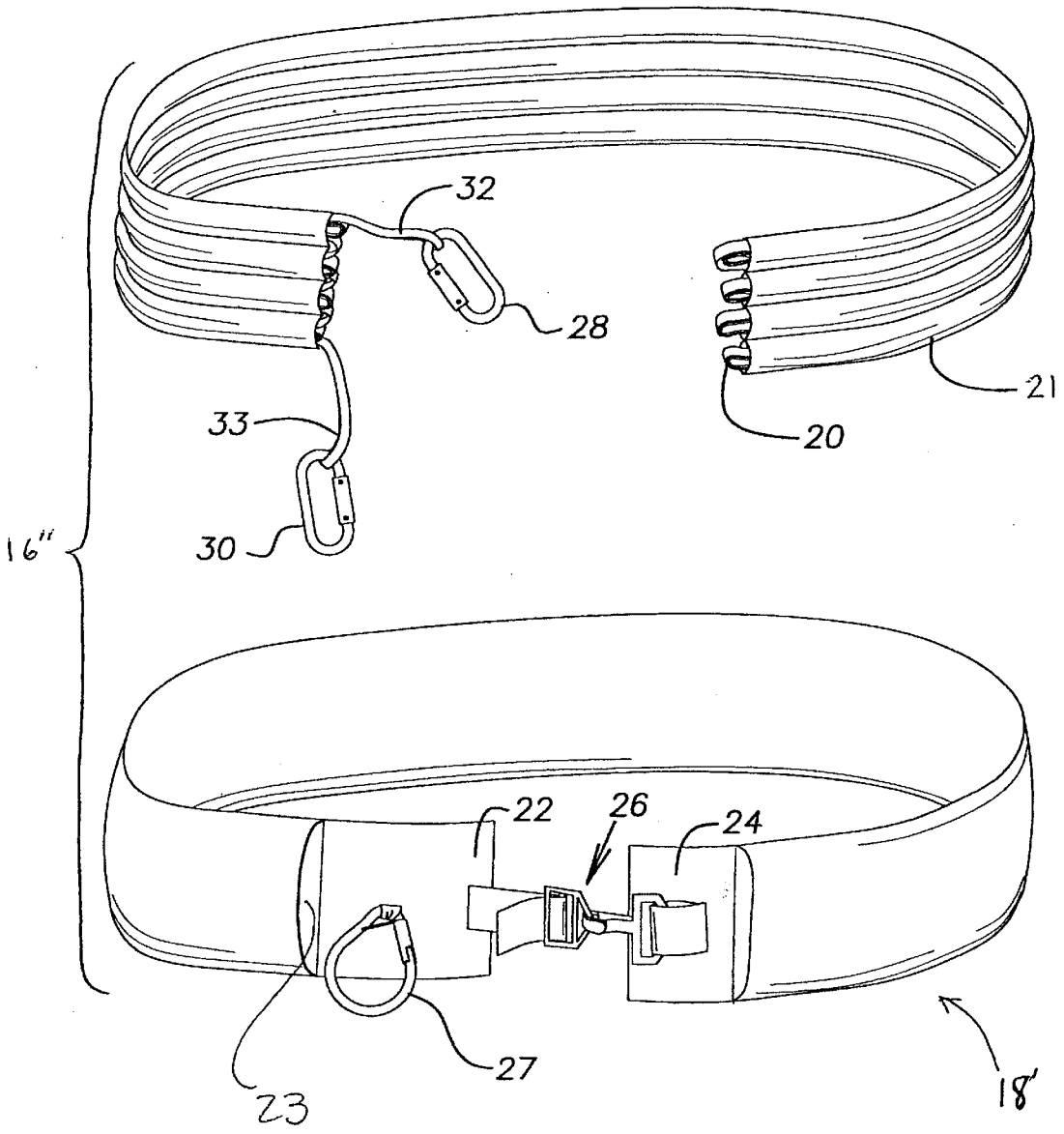
FIG. 5 is an exploded perspective view of a second embodiment of the harness assembly according to the present invention.

With reference to FIG. 5, an alternative harness assembly 16" is illustrated. Although the alternative construction of FIG. 5 is shown with regard to a belt-type harness assembly, it is considered apparent that the alternative construction is equally applicable to a shoulder harness, and may be readily incorporated into the turnout gear pants or coat.

The harness assembly 16" includes a harness body 18', a support line module 21, and a support line 20. The harness body 18' has a first end 22 and a second end 24, and a hollow portion or chamber 23 extending generally between the first and second ends 22, 24. The harness body carabiner 27 is secured to the harness body first end 22. A clip-and-ring type fastener 26 is provided to secure the first and second ends 22, 24 together, as illustrated.

The support line module 21 is shaped generally as a hollow pouch or length of material, and is adapted to receive the support line 20. The module 21 is adapted to be slidably inserted into and removed from the hollow chamber 23 of the harness body 18'. When the module 21 is installed within the chamber 23, the support line first and second ends 32, 33, with associated carabiners 28, 30, are positioned near the harness body first end 22. The second carabiner 30 is secured to the harness body carabiner 27. It is noted that, after the module 21 is inserted into the chamber 23 and the second carabiner 30 is secured to the harness body carabiner 27, operation of the harness body 16" is substantially identical to that of the harness body 16, 16' described hereinbefore.

However, with the alternative construction shown in FIG. 5, once the support line 20 is removed from the harness assembly 16", the module 21 is simply slidably removed from the chamber 23, and replaced with a new module having a fresh or new support line 20 therein. Accordingly, the alternative construction greatly simplifies replacement of the support line. This is considered quite important in safety harness applications wherein a support line may only be used one time before it is discarded.

While the preferred embodiments of the present invention are shown and described herein, it is to be understood that the same is not so limited but shall cover and include any and all modifications thereof which fall within the purview of the invention. For example, although the support line module is described herein as being slidably received within the harness body portion chamber, it is considered that various equivalent structures for releasably securing the module to the harness body portion could be devised by one skilled in the art. For example, the module may be releasably secured to the harness body portion by fasteners, such as snaps, buttons, or hook-and-loop type fabric.

What is claimed is:

1. A garment, comprising:

an outer layer;

a harness assembly secured to an interior of said outer layer, said harness assembly comprising a harness body and a support line, said harness body defines a chamber, said support line being received and stored within said harness body, said support line having a first end which is accessible from an exterior of said outer layer, said first end being withdrawn from said harness body by pulling said first end relatively away from said garment outer layer.

2. A garment according to claim 1, wherein said support line has a second end, said second end being accessible from the exterior of said outer layer and being releasably secured to said harness body.

3. A garment according to claim 1, further comprising an inner liner removably secured to an interior of said outer layer, said harness body being disposed between said inner liner and said outer layer.

4. A garment according to claim 1, wherein said outer layer has an opening through which said support line first end extends.

5. A garment according to claim 4, wherein said opening is normally covered by a flap, said flap being secured to said outer layer.

6. A garment according to claim 4, wherein said support line has a second end, said second end extending through said outer layer opening and being fixed relative to said harness body.

7. A garment according to claim 6, further comprising an inner liner removably secured to an interior of said outer layer, said harness body being disposed between said outer layer and said inner liner.

8. A garment according to claim 7, wherein said opening is normally covered by a flap, said flap being secured to said outer layer.

9. A garment according to claim 1, wherein said harness assembly includes a fastener for releasably securing a first end of said harness body to a second end of said harness body.

10. A garment according to claim 9, wherein said support line has a second end, said second end being accessible from the exterior of said outer layer and being releasably secured to said harness body.

11. A garment according to claim 10, wherein said outer layer has an opening through which said support line first and second ends extend.

12. A garment according to claim 11, wherein said opening is normally covered by a flap, said flap being secured to said outer layer.

13. A garment according to claim 1, wherein said harness assembly include a support line module, said module being secured to said harness body and receives said support line.

14. A garment according to claim 13, wherein said module is slidably received within said chamber.

15. A harness assembly, comprising:

a harness body portion defining a chamber and having a first end and a second end;

a fastener for releasably securing the first end to the second end to releasably secure said harness body portion around a wearer;

a support line received by said harness body portion, said support line having a first end and a second end which extend from said harness body portion, said support line being removed from said harness body portion by pulling said support line first end away from said harness body portion, said support line second end being releasably secured to said harness body portion.

16. A harness assembly according to claim 15, wherein said support line first end and said support line second end each have a coupler secured thereto.

17. A harness assembly according to claim 16, wherein said coupler is a carabiner.

18. A harness assembly according to claim 15, wherein said support line is disposed in said harness body portion in a serpentine fashion so that a length of said support line is much greater than a length of said harness body portion.

19. A harness assembly according to claim 15, wherein said support line is made from a heat and fire resistant material.

20. A harness assembly according to claim 15, wherein said harness assembly is adapted to be secured to an interior of an article of clothing.

21. A harness assembly according to claim 15, further comprising a support line module, said module being secured to said harness body portion and receiving said support line.

22. A harness assembly according to claim 21, wherein said module is slidably received within said chamber.

23. A method for using a garment to escape from a building, said garment including an outer layer and a harness assembly, said harness assembly comprising a harness body defining a chamber and a support line, said harness body being secured to an interior of said outer layer and receiving said support line, a first end of said support line being accessible on an exterior of said outer layer, comprising the steps of:

accessing said first end of said support line;

withdrawing a length of said support line from said harness body by pulling said first end of said support line relatively away from said harness body;

securing said support line first end in a fixed position relative to said building;

holding said support line and controllably withdrawing support line from said harness body to lower oneself down a side of said building.

24. A method for using a garment to escape from a building according to claim 23, wherein said garment also includes a flap which is normally closed to conceal said support line first end, and wherein said accessing step includes the step of opening said flap to reveal said first. end of said support line.

25. A method for using a garment to escape from a building according to claim 24, wherein a second end of said support line is releasably secured to the harness body and is accessible on the exterior of said outer layer, comprising the further step of releasing said second end from said harness to disconnect said support line from said garment.

* * * * *